US005638681A

United States Patent [19]

Rapp

[11] Patent Number: 5,638,681

[45] Date of Patent: Jun. 17, 1997

[54] PISTON INTERNAL-COMBUSTION ENGINE

[76] Inventor: Manfred Max Rapp, Schöneberger Str. 84e, 22149 Hamburg, Germany

[21] Appl. No.: 645,912

[22] Filed: May 14, 1996

Related U.S. Application Data

[63] Continuation of Ser. No. 367,290, filed as PCT/EP93/01863, Jul. 15, 1993, abandoned.

[30] Foreign Application Priority Data

Jul. 17, 1992 [DE] Germany ..... 42 23 500.6

[51] Int. Cl.[6] ..... F01B 29/04; F02B 33/00

[52] U.S. Cl. ..... 60/712; 123/68

[58] Field of Search ..... 60/712; 123/68, 123/560

[56] References Cited

U.S. PATENT DOCUMENTS

| | | | |
|---|---|---|---|
| 1,849,324 | 3/1932 | Goldsborough | 60/712 |
| 4,418,657 | 12/1983 | Wishart | 123/68 |
| 4,433,549 | 2/1984 | Zappia | 60/712 |
| 4,696,158 | 9/1987 | DeFrancisco | 60/39.62 |

FOREIGN PATENT DOCUMENTS

| | | |
|---|---|---|
| 2593231 | 7/1987 | France . |
| 2753584 | 6/1979 | Germany . |
| 3737743 | 5/1989 | Germany . |
| 3737820 | 8/1989 | Germany . |
| 4120167 | 12/1992 | Germany . |

OTHER PUBLICATIONS

"Internal Combustion Engine for Air Compressor", Ozawa Masao (Hino Motors Ltd.), European Patent Office, Patent Abstracts of Japan, publication No. JP2102332 published 13 Apr. 1990, abstract published Jul. 4, 1990, vol. 14, p. 311.

*Primary Examiner*—Michael Koczo
*Attorney, Agent, or Firm*—Walter C. Farley

[57] ABSTRACT

The invention concerns a piston internal-combustion engine with separate compression (K) and expansion (E) chambers and a compressed-gas transfer device (7) which feeds compressed gas from the compression chambers to the expansion chambers at the beginning of ignition. A control unit (7) is provided which, depending on the mode of operation, feeds the compressed gas either to the expansion chambers or to a pressure accumulator (10) from which the expansion chambers can also be operated in a pure compressed-air mode.

6 Claims, 3 Drawing Sheets

Figure 8:
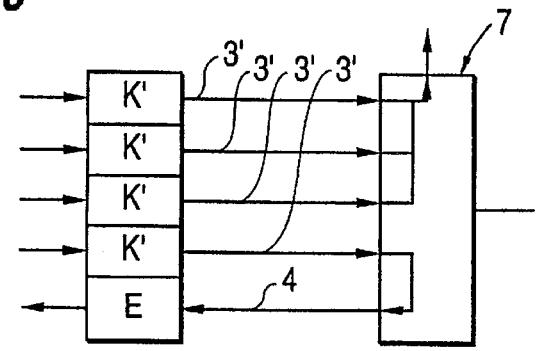

FIG. 1
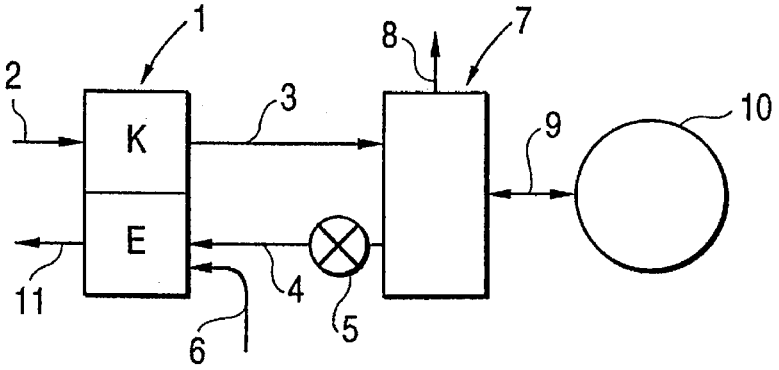
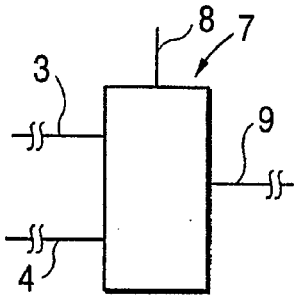
FIG. 1A
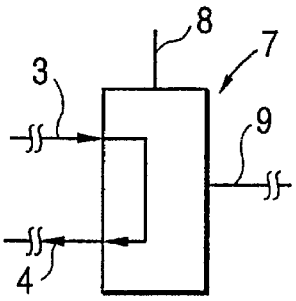
FIG. 2
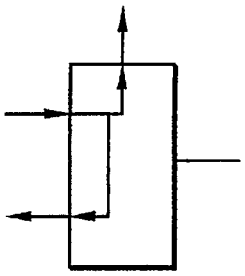
FIG. 3
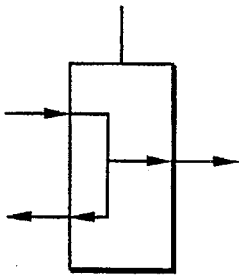
FIG. 4
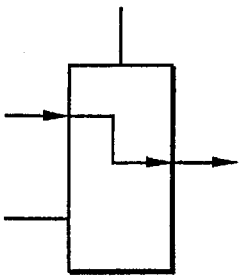
FIG. 5
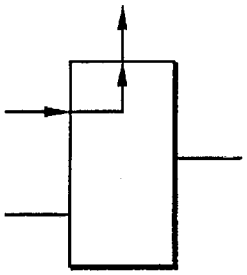
FIG. 6
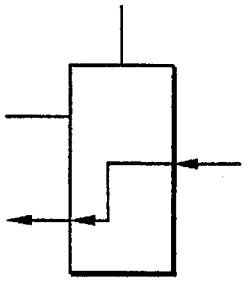
FIG. 7

PISTON INTERNAL-COMBUSTION ENGINE

This application is a continuation of U.S. Ser. No. 08/367,290, filed Jan. 11, 1995, now abandoned, which is a 371 continuation of PCT/EP93/01863, filed Jul. 15, 1993.

FIELD OF THE INVENTION

The invention concerns a piston internal-combustion (IC) engine having an expansion chamber, a compression chamber, a pressure tank and a control unit for controlling the transfer of air between the tank and the chambers.

BACKGROUND OF THE INVENTION

Such piston IC engines are described for instance in the German Gebrauchsmuster 90 02 335 and 90 13 928 and furthermore in the post-published, earlier application P 42 18 847.4.

One or more expansion chambers are provided in such piston IC engines and are fed with air compressed to ignition pressure and with fuel at the time of onset of expansion. The expansion chambers drive at least one separate compression chamber delivering the necessary compressed air at the required pressure, the compressed air being controlled by a transfer device and fed at the right time into the expansion chambers. Valves, for instance, are provided as the control means. Illustratively injection nozzles are provided for the fuel feed and inject directly into the expansion chambers or into the compressed-air feed tubes. Moreover, ignition devices are present for the preferred Otto- or gasoline-engine cycle in the expansion chambers.

If for instance such piston IC engines are operated in irregular modes, for instance in cars in city-traffic, then the known drawbacks of IC engines, especially of gasoline engines, will be incurred. Partial-load operation is predominant, during which excess compression takes place, and efficiency is low as a result. During frequent and brief accelerations, for instance when starting from a stop, unfavorable engine operating conditions apply, with incomplete combustion and high emissions of exhaust gases that cannot be fully controlled even using purifying techniques.

SUMMARY OF THE INVENTION

An object of the present invention is to improve the fuel consumption and exhaust emissions of the piston IC engine of the initially cited species when operating at partial loads and when the operating conditions change frequently.

In the design of the invention, a pressure tank is used to allow storage of excess compressed air arising at partial loads. If, with commensurate design of the compression chambers, the pressure level in the storage vessel is selected to be high, then considerable energy may be stored and can be used during the air-driven operation of the expansion chambers during most of the acceleration stages and for part of the uniform operational stages. As a result, fuel-driven operation for city acceleration is rarely required and highly disadvantageous consumption and high noxious emissions are precisely avoided at such junctures. Illustratively, substantial fuel can be saved in car city traffic and most of the noxious emissions can be avoided. The required and comparatively complex control means can be implemented reliably and economically using present-day technology, for instance resorting to computer support, to suitable valves and pressure regulators. The control means assures that during fuel-driven operation, compressed air for the expansion chambers at the required pressure, for instance of 10 to 15 bars (higher for diesel operation), can be made available to the piston IC engine, and that, in partial-load operation, excess compressed air, or compressed air present when braking the engine, can be stored at a higher pressure level of 60 bars for instance. The expansion chambers may be driven by compressed air alone during acceleration, the power corresponding to that from normal operation with fuel, or if called for even higher. Accordingly, operational drawbacks are absent. The engine torque is the same, or where called for higher than for fuel-driven operation. Following charging the pressure tank, for instance when a car idles at a red light, the engine may be shut off and it may be accelerated by compressed air up to the city speed limit of 50 km/h at full power. The present invention meets all car emission criteria in Europe, USA or Japan, without resort to known, expensive accessories such as catalysts.

Dividing the pressure tank into separately pressurizable segments is advantageous. Alternating operational modes, for instance such as are incurred in car city traffic, are better controlled using separately operating—pressure-tank parts, full pressure being available, after emptying one pressure tank, in the remaining ones.

Providing means for exchanging heat between the exhaust gases and the pressure tank also is advantageous. The heating of the stored compressed air by means of the engine exhaust gases allows raising the gas pressure and hence the energy content of the pressure tank, whereby the engine can be driven longer by air alone.

An engine having several compression chambers advantageously has its control unit configured to vent unthrottled individual compressed air output lines of the compression chambers. In this manner power losses when venting compressed air when the pressure tank is full can be reduced because said losses depend on the magnitude of the pressure of the vented compressed-air.

The design of the invention allows operating car engines in city traffic, for instance in the manner of the European test cycle, in highly economical and low-emission manner. When decelerating or standing, that is when the engine need not be running, said engine is automatically shut off. In deceleration the energy of deceleration is used to charge the pressure tank. The engine then acts as the engine brake. The braking energy used to charge the pressure tank substantially recovers the applied energy of acceleration, less losses.

In this process the fuel consumption is restricted to engine starting and to subsequent motion until the pressure tank is operationally ready, for instance for a duration of 50 seconds. Thereafter fuel is required only in uniform operational stages, that is in partial load operation, and for generating compressed air, while interim accelerations and initial motions can be implemented from the compressed-air engine drive.

In typical city traffic, the engine idle occupies about 30% of the operating time. In acceleration stages with ensuing, brief uniform-speed motion of a few seconds, possible in the compressed-air engine-drive mode, the proportion is about 40%, as a result of which the approximately remaining 30% of operational time is fuel driven.

Fuel savings may be 50 to 60%. The excess power of compressor operation for instance is 10 to 20%.

Noxious emissions are permanently lowered, in particular those of $NO_x$, CO and HC.

Noise generation also being substantially lessened in compressed-air engine drive, the mean noise load too is lowered.

Catalysts need not be used because in the invention the noxious emissions meet the statutes.

Figure 9:
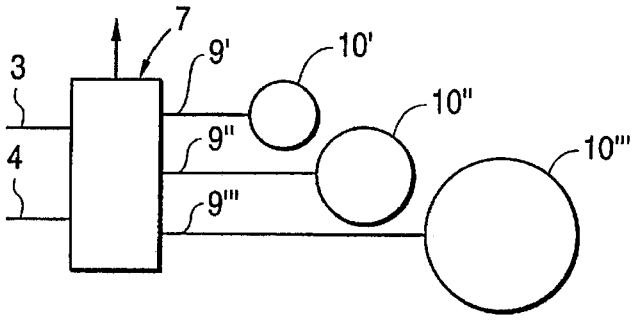
Figure 10:
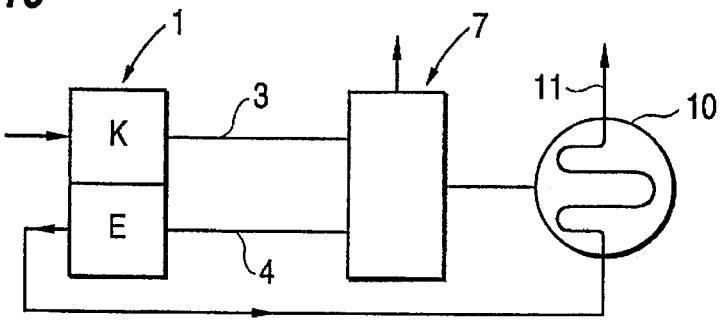
Figure 10A:
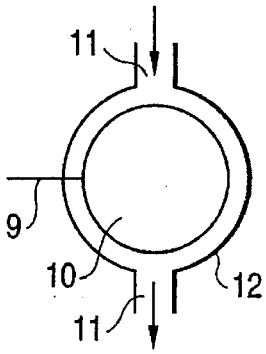
Figure 11:
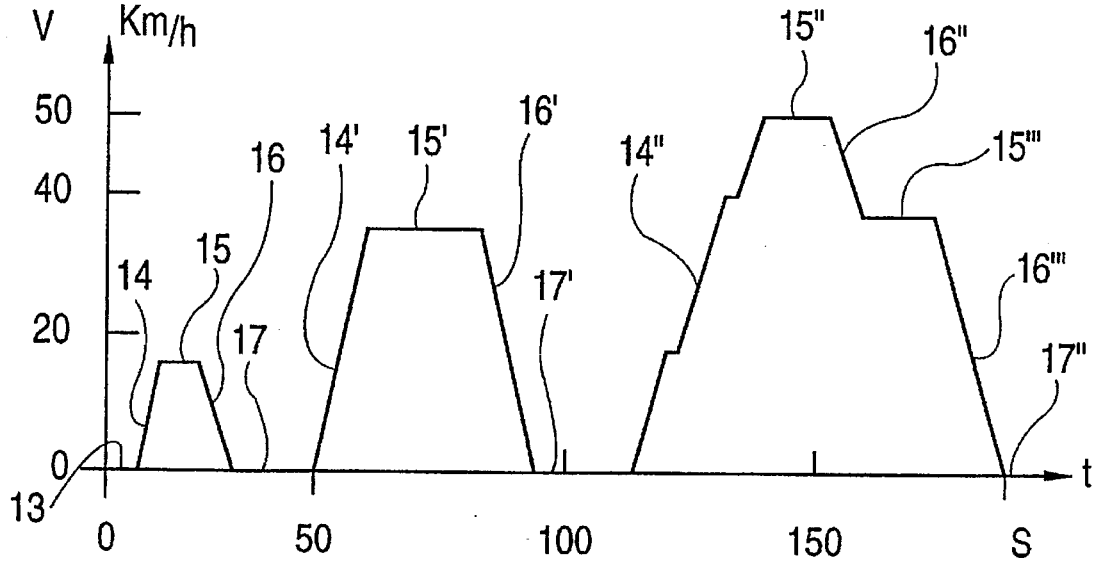
Figure 12:
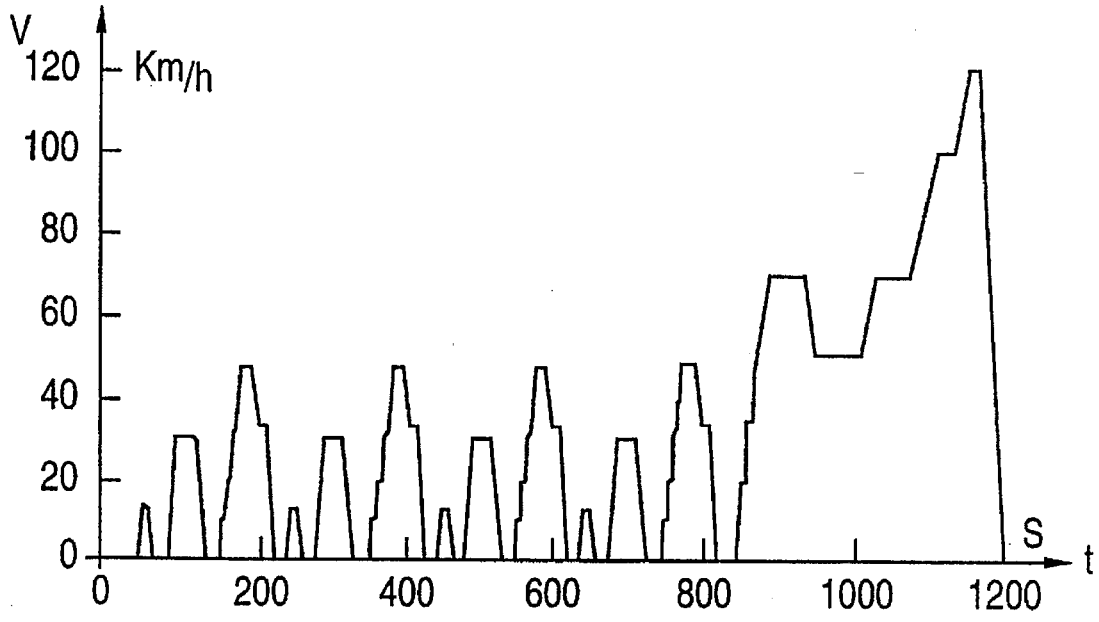

The invention is shown in illustrative and schematic manner in the drawings wherein:

FIG. 1 is a functional block diagram of the piston IC engine with its control unit, FIGS. 1A through 7 are diverse control-positions of the control unit for various operational modes, FIG. 8 is an embodiment which is a variation of FIG. 1 for separate control of the compressed-air lines of different compression chambers, FIG. 9 is an embodiment which is a further variation of FIG. 1 with a divided pressure tank, FIGS. 10 and 10A are embodiments which are further variations of FIG. 1 with exhaust-gas heated pressure tanks, FIG. 11 is a diagram of time-speed (drive curve of ECE/EG exhaust test cycle) for a car in city traffic, and FIG. 12 is similar to FIG. 11 but for a broadened, future European exhaust test cycle.

FIG. 1 is a functional block diagram of a piston IC engine 1 of the invention. Said engine comprises a compressor part K and an expansion part E as indicated. The compressor part K sucks in air through an inlet 2 and delivers compressed air through a compressed-air output line 3. The expansion part E receives compressed air through a compressed-air input line 4 containing a power-controlling throttle 5. Moreover, fuel is fed through an injection line 6 to expansion part E, the injection being implemented either into the compressed-air input line 4 or directly into the expansion chambers.

The configuration of such a piston IC engine 1 is described in various embodiments in German Auslegeschriften 90 02 335 and 90 13 928 and also in copending U.S. patent application 08/351,291 (allowed) and these documents are hereby referred to.

The engine shown in above-mentioned Ser. No. 08/351,291 is especially appropriate for the present invention. In that engine, the piston IC engine 1 comprises parallel rotating pistons in one or more slab-shaped operational chambers, said pistons each running in bearings on the cranks of two crankshafts arranged in parallel for angularly synchronous rotation, each point of such a piston rotating along a circle with the crank radius. One or more semi-circular operational surfaces are present in each piston, and said surface(s) cooperate(s) with sealing strips in a chamber which is also semi-circular and which is present in the housing periphery, where said chamber moreover may be in the form of an expansion or compression chamber. Preferably one piston surface cooperates with two adjacent peripheral surfaces forming one expansion chamber and one compression chamber. The compressed-air output lines of the compression chambers are schematically denoted as a whole by 3 in FIG. 1. FIG. 1 also schematically shows the set of compressed-air input lines of the expansion chambers by the reference 4.

Modified engine designs also may be used, for instance of reciprocating pistons. Illustratively the expansion part of the piston IC engine 1 may comprise one or more cylinders with pistons operated in the two-cycle mode and further comprising intake valve-control devices admitting compressed air from the compressed-air input line 4 in the time range of the upper piston dead center point at the beginning of the expansion stroke, at which time furthermore fuel is added from the injection line 6 and, for the Otto-cycle, ignition is implemented by a suitable ignition device.

The compression part K might be a flange-an conventional high-pressure compressor, for instance a multi-stage piston compressor with a large low-pressure piston and a small high-pressure piston. Such a compressor also may be integral with the expansion part, for instance in the form of a six-cylinder unit of four expansion cylinders and two compression cylinders of a different size.

The device for transferring compressed air from the compression chambers to the expansion chambers comprises the shown compressed-air output line 3 and the compressed-air input line 4, further (omitted) intake and outlet valves and a control unit 7 merely indicated in box-shaped manner in the Figure. The compressed-air output and input lines 3 and 4 resp., as well as a vent line 8 for excess compressed air and a storage line 9 leading into a pressure tank 10, such as a commensurately pressure-proof air tank, are connected to said control unit 7.

Illustratively, control unit 7 is controlled by a computer The computer monitors the operating conditions of the IC engine, and also the traveling conditions of the vehicle which contains the engine, using suitable pressure, temperature, RPM and speed sensors and, where called for, additional sensors. The computer, as a function of said operational conditions treats the compressed air in different ways according to the internationally different exhaust tests, as shown in the following figures.

FIG. 1A shows the control position diagram of the control unit 7 when the engine is shut off, for instance waiting at a traffic light or when the vehicle is parked. The control unit 7 blocks all inputs and outputs.

FIG. 2 shows the control position diagram of the control unit 7 for full-load operation of the piston IC engine 1, for instance when driving a motor vehicle at maximum speed. In this case the total compressed air supplied by the compressor part K is needed to drive the expansion part E. As shown in FIG. 2, the control unit 7 connects the compressed-air output line 3 directly to the compressed-air input line 4 in this operational mode.

FIG. 3 shows the control position diagram of the control unit 7 for a prolonged partial load operational mode, for instance when driving a motor vehicle a long way at constant 50 km/h. The pressure tank is full. In this case a lesser portion of the compressed air delivered by the compressed-air output line 3 is needed for the expansion part 4. Excess compressed air is blown off through the vent line 8. The control unit 7 is designed in such manner that the venting of compressed air shall take place at the lowest possible pressure level. On the other hand the pressure driving the expansion part E must be kept at a pressure level corresponding to the air pressure at the onset of the expansion stroke, that is, for instance, at 10 to 15 bars. Compressed-air venting may be carried out at that pressure to simplify the design of the control unit 7.

FIG. 4 shows the control position diagram of the control unit 7 for partial load operation wherein the pressure tank 10 is still empty or incompletely filled. Part of the compressed air is fed to the expansion part 4. Another portion of the compressed air is fed through the storage line 9 to the pressure tank 10. The control unit 7, should be designed in such manner (not shown for clarity) that higher pressure for instance of 60 bars is supplied to the storage line 9, while compressed air for instance of about 10 to 15 bars required to operate the expansion part is supplied to the compressed-air input line 4. Illustratively, a pressure reducer may be used.

FIG. 5 shows the control position diagram of the control unit 7 for an operational mode wherein the compressor part K delivers compressed air while the expansion part E on the other hand does not require compressed air, for instance during braking the piston IC engine, that is when braking a vehicle. In this travel mode the compressor is used as the engine brake. If the pressure tank 10 is not entirely filled, the generated compressed air is fed into it, but if it is full, the compressed air is vented as shown in the control position diagram of FIG. 6.

FIG. 7 shows a control position diagram of the control unit for an operational mode in which pressure tank 10 is adequately filled while the piston IC engine 1 demands higher power, for instance during vehicle acceleration. In this case compressed air from pressure tank 10 is fed to the expansion part E, the control unit 7 ensuring that the fuel supply from the injection line 6 be shut off. The expansion chambers of the expansion part E are then operated solely with compressed air in the compressed-air engine drive mode. Pressure reducers (not shown) of control unit 7 are able to reduce the higher storage pressure in the pressure tank 10 to the specific pressure required in the expansion part 7.

The compression chambers of compression section K in the piston IC engine 1 of FIG. 1 must be configured in such manner that they generate a maximum compression pressure substantially higher than required to feed the expansion part. In the case of the Otto, i.e. gasoline engine, discussed here, the expansion chambers require an air pressure of 10 to 15 bars at the onset of ignition, and said air pressure must be applied through the compressed-air input line 4 in order to achieve a mixture igniting at fuel addition for gasoline-engine operation. Following ignition, the maximum pressure in the expansion chamber is 40 bars for instance.

If the engine is to be operated at the same power in the compressed-air engine drive mode shown by the control position diagram of the control unit 7 of FIG. 7, then compressed air at about 20 to 30 bars must be fed to it from the tank 10 at the appropriate rate. Accordingly the compression chambers of the compression section K must be designed for a maximum pressure of about 60 bars. The actually generated final pressure in the compression chambers depends on the pressure control at the end of the pressure output line 3 present in the control unit 7. If, for instance as shown in FIG. 6, only pressure relief to the ambient is taking place, then the relief may be unthrottled to lower losses, as a result of which compression losses are minimized. As regards the operational mode of FIG. 3, the maximum compression pressure is limited for instance to 10 to 15 bars.

FIG. 8 shows an advantageous design wherein different compression chambers K' are separately connected in the manner shown by parallel compressed-air output lines 3' to the control unit 7. In the shown operational mode of very low permanent partial load, only one of the compression chambers K' is connected to the to the expansion part E to feed it. The other three shown compression chambers are vented unthrottled. If the power demand of the piston IC engine 1 increases, then further compression chambers may be connected to supply the expansion part until finally, with all the gas supplied, all the compression chambers are turned ON to feed the expansion part E. If the pressure tank 10 is less than wholly filled, the pressure output lines 3' can be connected singly or severally to fill the pressure tank.

FIG. 9 shows an embodiment wherein the pressure tank 10 is divided into pressure-storing segments 10', 10", 10''' of different sizes which are connected by individual storage lines 9', 9", 9''' to the control unit 7. This embodiment permits better budgeting of the stored compressed gas. For instance, depending on demand, one of the pressure storing segments can be entirely drained while the others remained filled at full pressure in order to be available for pure compressed-air engine drive operation as shown in FIG. 7 in the event of a sudden demand for high power.

Lastly, FIG. 10 shows an embodiment wherein the exhaust-gas line 11 of the expansion part is used for heat exchange with pressure tank 10. The Figure illustrates this feature by mounting part of the exhaust-gas line 11 as a pipe coil in the tank 10. FIG. 10A shows an alternative design wherein the exhaust gas of the exhaust-gas line 11 is made to pass through a jacket 12 of the pressure tank 10.

If air, for instance at 400° C., is fed from the compressor section of piston IC engine 1 to pressure tank 10 at a pressure, illustratively, of 30 bars and thereupon said air is raised by the hot exhaust gases in the exhaust-gas line 11 to a higher temperature, for instance 800° C., then the pressure in the tank 10 rises substantially, for instance to 60 to 80 bars, whereby the energy content of the tank 10 is increased and can be utilized for extended compressed-air engine drive operation of expansion part E of piston IC engine 1.

The invention is especially efficacious in the range of changing partial loads as encountered in city motor-vehicle traffic. The following four driving conditions often recur:

acceleration from rest, constant-speed phase, deceleration, at stop (for instance at traffic light).

These driving conditions are taken into account in the invention by corresponding control positions of the control unit 7, this unit being able to switch over to different positions, depending on the travel status, as shown in the control positions of FIGS. 1A through 7.

Elucidation is offered by FIG. 11 reproducing the speed diagram of the ECE/EG European exhaust-gas test cycle which is used in the automotive industry to simulate city traffic. The shown diagram is repeated four times in immediate succession in the European test. Total exhaust-gas emission values are determined.

The following discussion elucidates the functioning of the object of the invention in the operational modes shown in FIG. 11.

The piston IC engine, merely called "engine" below, starts cold at 13, with the pressure tank 10 empty, and operating in the fuel mode. The control unit 7 switches into the control position of FIG. 4. At 14, acceleration takes place and merges into a constant speed phase 15. Thereupon deceleration 16 occurs, at which control unit 7 switches into the control position of FIG. 5. A standing phase 17 in the switch position of FIG. 1A follows.

After about 50 sec. from engine start at 13, pressure tank 10 is filled and ready for operation. The engine switches over to the compressed-air drive mode, that is, the fuel supply and ignition are shut off.

The next acceleration at 14' can then be carried out in the pure air drive mode in the control position of FIG. 7, and this air-driven mode furthermore may be retained over a time interval of about 3 to 5 sec. of the ensuing constant-speed phase 15'. Thereupon and during the constant speed mode 15', the engine is automatically switched over to gasoline operation as shown in the control position of FIG. 4 in order that the air losses in pressure tank 10 may be replenished.

Thereafter and with delay at 16', the fuel is shut off and the control unit is switched into the control position of FIG. 5 to further replenish pressure losses in the pressure tank 10.

At 17', the fuel supply to the vehicle is shut off and control unit 7 is in the control position shown in FIG. 1A. Thereupon new acceleration takes place at 14" in the air-driven mode of the control position of FIG. 7. Again the following constant-speed phase 15" is initiated while still in the air-driven mode. The deceleration phase 16" is once more used to charge the tank 10 by means of the control position of FIG. 5. The next constant-speed phase 15''' is carried out again initially in the compressed-air drive mode and then in the fuel-drive mode. A deceleration 16''' occurs until standing at 17". The phases 14" through 17" are implemented exactly as described in relation to 14' through 17'.

After passing four times through the travel conditions shown in FIG. 11 in accordance with the Europe test, the acceleration phase 14 begins anew, but this time only by means of the filled tank 10 in the compressed-air drive mode of FIG. 7.

FIG. 12 shows another travel cycle anticipated as a future Europe exhaust-gas emission test. Initially it corresponds to repeating four times the test cycle of FIG. 11, but it is furthermore broadened by an adjoining range of higher speeds. In this case too the compressed-air drive mode may be used when starting from rest and for interim accelerations.

I claim:

1. An engine for a motor vehicle, said engine having an internal combustion engine mode of operation and an unfueled compressed air engine mode of operation, said engine comprising means defining at least one expansion chamber of variable volume providing power output from said engine to drive said vehicle; and means defining at least one compression chamber of variable volume separate from said at least one expansion chamber said at least one compression chamber and delivering compressed air only in internal combustion mode and during deceleration always at a greater pressure than necessary for feeding said expansion chamber;

a pressure tank (10) for providing compressed air;

a transfer unit to transfer compressed air from said at least one compression chamber into said at least one expansion chamber substantially at a time of onset of expansion in said expansion chamber;

sensor means for producing data representing the status of the motor vehicle including vehicle acceleration;

said transfer unit comprising a control unit (7) for receiving air under pressure from said at least one compression chamber and delivering air at a required pressure to said at least one expansion chamber (E), said control unit responding to said vehicle status data to switch the operating mode of said engine from said combustion engine mode to said compressed air engine mode when said vehicle is accelerating and pressure in said tank is no lower than a predetermined level;

fuel supply means for supplying fuel to said at least one expansion chamber only during said combustion engine mode and for stopping fuel supply during said combustion engine mode during deceleration if pressure in said tank is no lower than said predetermined level;

said control unit including, when operating said engine in combustion mode, means for feeding said compressed air from said compression chamber to said expansion chamber at a controlled pressure level needed at ignition for required output power of said engine, supplying compressed air in excess of that required for engine operation to fill said pressure tank up to a maximum pressure delivered by said compression chamber, and venting excess air from said at least one compression chamber when said tank is at a full pressure level;

and when operating said engine in compressed air mode, means for receiving compressed air exclusively from said pressure tank, and supplying said compressed air in the absence of fuel to said expansion chamber at a pressure level adequate to produce a required power output of said engine.

2. An engine according to claim 1 wherein said tank includes means for dividing said tank into a plurality of separate pressurizable chambers.

3. An engine according to claim 1 wherein said engine includes an exhaust gas conduit and said tank includes heat exchange means for exchanging heat between said exhaust gas line and said tank.

4. An engine according to claim 3 including a plurality of compression chambers and wherein said means for venting includes means for unthrottled individual venting of said compression chambers.

5. An engine according to claim 1 including a plurality of compression chambers and wherein said means for venting includes means for unthrottled individual venting of said compression chambers.

6. A piston engine according to claim 1 wherein said data produced by said sensor means includes vehicle speed, and wherein said fuel supply means additionally stops fuel supply when said vehicle is stopped if pressure in said tank is no lower than said predetermined level.

* * * * *